US007385504B2

(12) United States Patent
Agrawal et al.

(10) Patent No.: US 7,385,504 B2
(45) Date of Patent: Jun. 10, 2008

(54) VENDING MACHINE DOOR MONITORING SYSTEM

(75) Inventors: Anant Agrawal, Diamond Bar, CA (US); A. Louis Beaudoin, Oakland, CA (US); Mandeep S. Arora, Danville, CA (US); Fred Cheng, Aliso Viejo, CA (US); Eric M. Chu, Laguna Niguel, CA (US)

(73) Assignee: Cantaloupe Systems, Inc., Berkeley, CA (US)

( * ) Notice: Subject to any disclaimer, the term of this patent is extended or adjusted under 35 U.S.C. 154(b) by 137 days.

(21) Appl. No.: 11/097,031

(22) Filed: Mar. 31, 2005

(65) Prior Publication Data

US 2006/0220845 A1 Oct. 5, 2006

(51) Int. Cl.
*G08B 13/08* (2006.01)

(52) U.S. Cl. ..... 340/545.1; 700/236

(58) Field of Classification Search ..... 340/545.1, 340/5.9; 361/91.1, 56, 111, 118; 700/236, 700/241, 244; 221/129; 709/217; 379/88.16, 379/67.1

See application file for complete search history.

(56) References Cited

U.S. PATENT DOCUMENTS 4,354,613 A * 10/1982 Desai et al. ..... 377/1
4,593,361 A * 6/1986 Otten ..... 700/238
4,598,378 A * 7/1986 Giacomo ..... 700/236
5,442,568 A 8/1995 Ostendorf et al.
6,339,731 B1 1/2002 Morris et al.
6,473,283 B1 10/2002 Melvin et al.
2003/0074106 A1* 4/2003 Butler ..... 700/236
2005/0008127 A1* 1/2005 Holmes et al. ..... 379/88.16
2005/0043011 A1 2/2005 Murray et al.

OTHER PUBLICATIONS

Kasavana, Michael L., "NAMA White Paper: Cashless Vending," The National Automatic Merchandising Association, 40 pages.

* cited by examiner

*Primary Examiner*—Brent A. Swarthout
(74) *Attorney, Agent, or Firm*—MacPherson Kwok Chen & Heid LLP

(57) ABSTRACT

A vending machine door monitoring system for an audit system is provided. This door monitoring system may utilize the same door switch utilized by the vending machine controller (VMC) in order to detect the state of an access door for the vending machine. This door monitoring system may have a separate power supply for applying a back-up voltage to a door circuit in the event that the VMC fails to supply the voltage. The door monitoring system may be further configured to detect a state of the door circuit regardless of the order in which the terminals from the door switch are coupled to the audit system.

34 Claims, 4 Drawing Sheets

VENDING MACHINE DOOR MONITORING SYSTEM

BACKGROUND

Vending machines have long been used for selling products to consumers. In the past, vending machine managers needed to send human operators to personally visit each vending machine in order to check on the status of the vending machine, to retrieve the collected cash, and to restock the vending machine with new products to replace the products that had been sold. These vending machines may be provided with a door switch, which would indicate to the vending machine controller whether the access door is open or closed. Many vending machines are configured such that when the vending machine controller detects that the door is open, the vending machine enters into "service mode."

A problem arises when there is a failure with the door switch such that the vending machine controller believes that the door is open when, in fact, the door is closed. When the vending machine is in service mode, customers are typically unable to purchase products from the vending machine. Thus, a malfunction of the door switch can prevent any sales from occurring, even when the vending machine is otherwise functioning properly. Even worse, when some vending machines are in service mode, a user may be able to reset the pricing of the products in the vending machine or cause the vending machine to vend product for free.

Recently, vending machines have been equipped with monitoring systems for monitoring the status of the vending machine and for keeping track of product sales and restocking. Even more recently, vending machines have been provided with monitoring systems capable of transmitting information regarding the status of the vending machine to a central server. In many cases, existing vending machines are retrofitted with these types of monitoring systems. These monitoring systems may enable the vending machine to report to a central host when a "door open" state is detected. This can help operators to identify machines with malfunctioning door switches. However, due to the wide variety of vending machine designs, the retrofitting process can be difficult and time-consuming, and require skilled service personnel for the installation.

Accordingly, it would be desirable to provide a vending machine monitoring system that can be easily installed at low cost.

SUMMARY

A vending machine door monitoring system for an audit system is provided. This door monitoring system may utilize the same door switch utilized by the vending machine controller (VMC) in order to detect the state of an access door for the vending machine. This door monitoring system may have a separate power supply for applying a back-up voltage to a door circuit in the event that the VMC fails to supply the voltage. The door monitoring system may be further configured to detect a state of the door circuit regardless of the order in which the terminals from the door switch are coupled to the audit system.

In accordance with embodiments of the present invention, an audit system for a vending machine system is provided. The vending machine comprises a housing including a door having a closed state and an open state, a door switch, and a vending machine controller (VMC) coupled to the door switch via a door circuit, said VMC applying a voltage across the door switch. The audit system comprises: an auxiliary circuit coupled to the door circuit; and an audit control system configured to detect the status of the door switch by monitoring the voltage from the VMC, wherein the audit control system is configured such that if the audit control system detects cessation of the voltage from the VMC, the audit control system applies an auxiliary voltage across the door switch to detect the status of the door switch.

In accordance with other embodiments of the present invention, a method of monitoring operation of a vending machine system is provided, said method comprising: monitoring a door circuit between a first power source and a door switch, said door switch engaging an access door for the vending machine system; in response to a cessation of a voltage from the first power source, applying a voltage from a second power source and continuing to monitor the door circuit between the first power source and the door switch.

In accordance with other embodiments of the present invention, a method of operating a vending machine system is provided, comprising: monitoring a door circuit coupling a door switch and a vending machine controller (VMC) using an audit system; detecting a cessation of voltage in the door circuit; and applying an auxiliary voltage to the door circuit to detect a status of the door switch.

In accordance with other embodiments of the present invention, a vending machine system is provided, comprising: a housing including a door having a closed state and an open state; a door switch; a first means for applying a voltage across the door switch and for detecting a state of the door switch; and a second means for detecting the state of the door switch, wherein said second means applies an auxiliary voltage across the door switch in response to detection of a cessation of the voltage applied by the first means.

Other features and aspects of the invention will become apparent from the following detailed description, taken in conjunction with the accompanying drawings which illustrate, by way of example, the features in accordance with embodiments of the invention. The summary is not intended to limit the scope of the invention, which is defined solely by the claims of the issued patent.

DETAILED DESCRIPTION

In the following description, reference is made to the accompanying drawings which illustrate several embodiments of the present invention. It is understood that other embodiments may be utilized and mechanical, compositional, structural, electrical, and operational changes may be made without departing from the spirit and scope of the present disclosure. The following detailed description is not to be taken in a limiting sense, and the scope of the embodiments of the present invention is defined only by the claims of the issued patent.

Some portions of the detailed description which follows are presented in terms of procedures, steps, logic blocks, processing, and other symbolic representations of operations on data bits that can be performed on computer memory. Each step may be performed by hardware, software, firmware, or combinations thereof.

Figure 1:
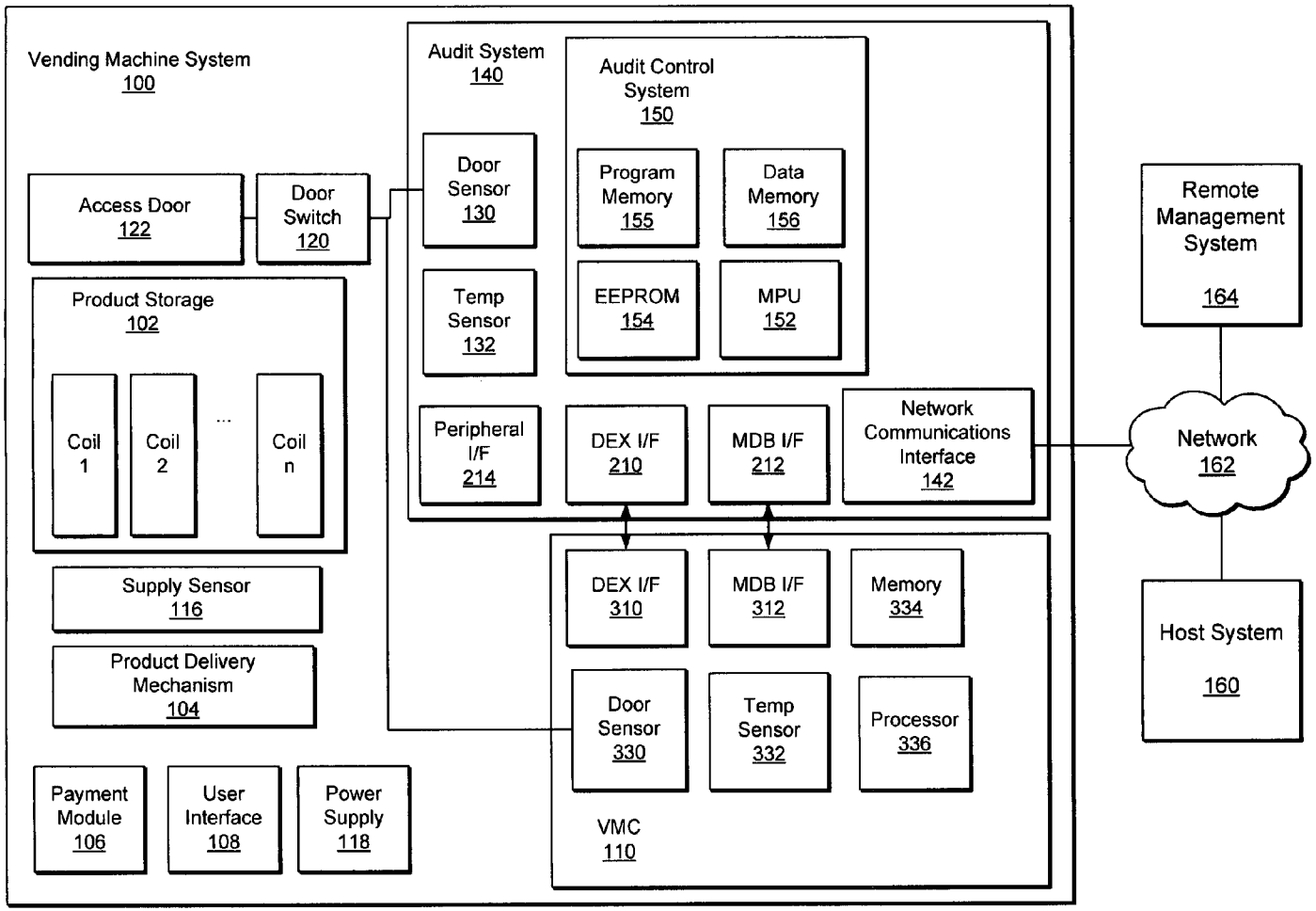
FIG. 1 shows a vending machine system, in accordance with embodiments of the present invention.

FIG. 1 is a block diagram of an arrangement for a vending machine monitoring system, in accordance with embodiments of the present invention. A vending machine system 100 is coupled to a host system 160 via a wide area network 162, such as the Internet. The vending machine system 100 comprises a vending machine controller (VMC) 110 and an audit system 140. The audit system 140 includes a communications interface 142 which provides a communications link to the network 162 and allows the audit system 140 to transmit operational data regarding the vending machine system 100 to the host system 160. This communications link may comprise, e.g., a wireless communications link. A remote management system 164 may also be provided to allow a user to access the operational data regarding the vending machine on host system 160 and to manage the operation of the vending machine system 100.

The vending machine system 100 includes a product storage portion 102, which stores the various types of products to be sold by the vending machine system 100 in one or more product storage compartments. These product storage compartments are sometimes referred to as "coils", in reference to the coil-shaped wire often used in conventional vending machines to control the delivery of products to customers.

The vending machine system 100 also includes a payment module 106, which may be configured to receive payment from a user in various forms, including, e.g., bills, coins, credit card, debit card, smartcard, wireless authorization (e.g., via cell phone), or the like. A user interface 108 is provided for allowing a user to make product selections. Typically, the user interface 108 will include a plurality of buttons, each button corresponding to a particular type of product available for sale. In other embodiments, the user interface 108 will include a keypad or touchscreen for entering product selections. The payment module 106 and user interface 108 are coupled to the VMC 110, which controls the operation of the vending machine system 100. During normal use, when a user has provided sufficient payment via the payment module 106 and makes a product selection via the user interface 108, the VMC 110 activates a product delivery mechanism 104, which retrieves the selected product from the appropriate product storage compartment and delivers the product to the user. One or more supply sensors 116 may be provided for monitoring the supply of products in the various coils. These supply sensors 116 may be configured to monitor the exact amount of product in each coil, to monitor when the supply of product in each coil reaches one or more predetermined monitoring levels (e.g., a restock warning level and an empty level), or to monitor when the supply of product in each coil is completely exhausted.

The vending machine 100 includes an access door 122 which is used by service personnel to restock the product storage portion 102, retrieve money from the payment module 106, download system and sales information from the VMC 110, make repairs, and perform other service-related duties. A door switch 120 engages the access door 122 such that the VMC 110 can detect when the access door 122 is opened.

The VMC 110 is configured to poll the various devices provided in the vending machine system 100 in order to determine the status of the system. For example, the VMC 110 continuously polls the payment module 106 to determine whether any money has been inserted into the system 100. When a customer inserts money into the payment module 106, the payment module 106 will respond to the VMC's polling with a message indicating the amount of money received. Once the appropriate amount of money is received from the customer and a selection is entered into the user interface 108, the processor 336 instructs the product delivery mechanism 104 to deliver the product corresponding to the customer's selection. The amount of cash received, the amount of change returned to the customer, and the product vended are stored in the memory 334 of the VMC 110. Thus, the VMC 110 is able to maintain a record of vending machine operational data, e.g. sales and cash.

In accordance with embodiments of the present invention, an audit system 140 is provided for monitoring the vending machine system 100. Although the audit system 140 may be provided as an integral component of the vending machine system 100, in many cases, the audit system 140 is a separate device that can be installed in an existing vending machine system 100. The audit system 140 comprises one or more interfaces for coupling the audit system 140 to other devices. This can be accomplished using, e.g., a serial interface, such as a DEX or MDB port, that communicates using a standard data protocol, such as DEX/UCS or MDB/ICP.

In the embodiment shown, the audit system 140 comprises a DEX interface 210 and a MDB interface 212, which couple to a corresponding DEX interface 310 and MDB interface 312 on the VMC 110. The DEX interface 210 comprises an interface which allows the coupled devices to communicate according to the DEX/UCS protocol. The physical connection provided by the DEX interface 210 may comprise a ¼ inch female socket. In this embodiment, the audit system 140 uses the DEX interface 210 to transmit and receive messages regarding operational data from the VMC 110. This may include requesting and receiving DEX files, as will be described in greater detail below.

The MDB interface 212 is an interface that complies with the standard established as the Multi-Drop Bus/Internal Communication Protocol (MDB/ICP), which is a serial bus interface for electronically controlled vending machines. The illustrated audit system 140 may use the MDB interface 212 to receive power from the power supply 118 via the VMC 110 and to interface with peripheral devices coupled to the VMC 110.

The audit system 140 may also be provided with a peripheral interface 214 for directly coupling the audit system 140 to peripheral devices without utilizing the VMC 110. This peripheral interface to 14 may comprise, e.g., a serial interface, such as the 12C interface.

The audit system 140 also comprises an audit control system 150, which implements the control logic for operation of the audit system 140. The audit control system 150 comprises a processor, shown as MPU 152, which can be, e.g., an AVR ATmega128 microcontroller by the Atmel Corporation of San Jose, Calif. The audit control system 150 may also be provided with one or more memory devices. In the embodiment shown, the audit control system 150 comprises an EEPROM 154, a flash memory 155, and a data memory 156. The EEPROM 154 may be used to store settings for the operational parameters of the audit system 140. The flash memory 155 may be used to store program data for execution by the MPU 152. The data memory 156 may comprise an SRAM memory for storing operational data retrieved from the VMC 110. In the AVR ATmega128 microcontroller, these memory devices are incorporated into the microcontroller. In other systems, the memory devices may be provided in separate devices.

The audit system 140 also comprises a communications interface 142 for coupling the audit system 140 to the network 162. The communications interface 142 may comprise any of a variety of types of communication interfaces, both wired and wireless. A wired interface may comprise any of a variety of well-known interfaces for coupling to wide-area networks via a wire, cable, fiber-optic, or other physical media for transmitting analog or digital data. A wireless interface may comprise any of a variety of well-known interfaces for establishing a wireless link to a wide-area network. The wireless interface may comprise a long-range wireless interface, such as a radio frequency (RF) modem for transmitting data using a variety of communication protocols, e.g., General Packet Radio Service (GPRS), Cellular Data Packet Data (CDPD), Code Division Multiple Access (CDMA), and Time Division Multiple Access (TDMA). In other embodiments, the communications interface 142 may comprise a short-range wireless interface using a short-range wireless protocol such as, e.g., IEEE 802.11 (WiFi), IEEE 802.15 (Bluetooth), and IrDA, as well as other types of RF transmissions, such as on the 900 MHz and 2.4 GHz frequencies. The short-range wireless interface may be provided for communicating with a base station receiver (not shown), which, in turn, is coupled to the wide-area network 162 for communication with the host system 160. The base station receiver may be used to provide wide-area network connectivity for a plurality of vending machine systems, which communicate with the base station receiver via the short-range wireless interfaces. This can serve to decrease the cost of the network connectivity provided in each vending machine system.

The host system 160 can communicate with the audit system 140 using a communication protocol, such as, e.g., User Datagram Protocol (UDP), File Transfer Protocol (FTP), Transmission Control Protocol (TCP), or the like, as would be understood by one of ordinary skill in the art.

The audit system 140 is configured to collect operational data from the VMC 110. This operational data may comprise information regarding sales (e.g., a coil name, unit price, cumulative sales total, and cumulative cash total), cash collection (e.g., "cash in": total cash inserted into the vending machine; "cash out": total cash output by the vending machine as change; "bills to stacker": total bills that are in the bill stacker; "coin to box": total coins that are in the coin box; "tube cash": total cash transferred to the coin tubes; "card cash": total "cashless" monetary value received by the vending machine), temperature, etc. In vending machine systems utilizing the DEX protocol, the audit system 140 collects operational data by requesting a DEX file from the VMC 110.

Under the DEX standard, the VMC generates an audit report file which includes information regarding the operation of the vending machine. This audit report comprises an ASCII text file including a series of lines containing audit information. The audit report also includes a header, a trailer, and a redundancy check, such as a checksum. Each line in the audit report file begins with an identifier, such as ID1, CA2, CA3, etc. The identifier identifies the type of data the line will provide. Each data field in each line is delimited by an asterisk (*).

The audit system 140 stores a set of data collection parameters which are the settings which govern the collection of operational data by the audit system 140. In the illustrated embodiment, the audit control system 150 is configured to interrogate the VMC 110 to request predetermined types of operational data. This interrogation occurs on a predetermined interrogation schedule. For example, the audit control system 150 may be configured to interrogate the VMC 110 to retrieve "cash in" and sales information every 10 minutes.

In order to transmit operational information regarding the vending machine system 100, the audit system 140 is configured to transmit reports to the host system 160 via the network 162. In accordance with some embodiments, the audit system 140 transmits three types reports: scheduled reports, alert reports, and on demand reports.

The scheduled reports provide a predetermined set of operational data to the host system 160 on a scheduled, periodic basis. The scheduled reports may include operational data retrieved from a plurality of interrogations. For example, the audit control system 150 may be configured to transmit a sales report once per day. This sales report would include the operational data collected from all the DEX interrogations over the previous 24 hours.

The alert reports provide a predetermined set of operational data in response to the detection of an alert condition in the vending machine system 100. The audit control system 150 may be configured to immediately transmit one or more alert reports in response to detection of various alert conditions. For example, if the temperature sensor 132 detects that the temperature within the vending machine system 100 has passed beyond a predetermined acceptable range of temperatures, the audit control system 150 will immediately transmit a temperature alert informing the host system 160 of the situation. The audit control system 150 may also be configured to transmit a door alert if the door sensor 130 detects that the access door 122 has been opened.

The on demand reports provide a set of operational data in response to receipt of a request for that data from the host system. For example, the host system may transmit a query to the audit control system 150 requesting the current amount of cash available. If the audit control system 150 already has the requested data in the data memory 156, the audit control system 150 will immediately respond to the host system 160 with the requested data. If the data is not available, then the audit control system 150 will request the data from the appropriate device, such as, e.g., the VMC 110, and then will transmit that data to the requesting host system.

The audit system 140 may include a door sensor 130, which is used to detect the state of the access door 122 for the vending machine system 100. Although it is possible to implement a door sensor by installing a separate door switch dedicated to the audit system 140, this would incur additional costs for the door switch hardware and for the labor to install the door switch. In addition, by utilizing the same door switch as the VMC, the audit system 140 is able to detect what the VMC believes the access door's state is. Accordingly, it would be desirable to utilize the existing door switch 120, rather than install separate hardware.

Figure 6:
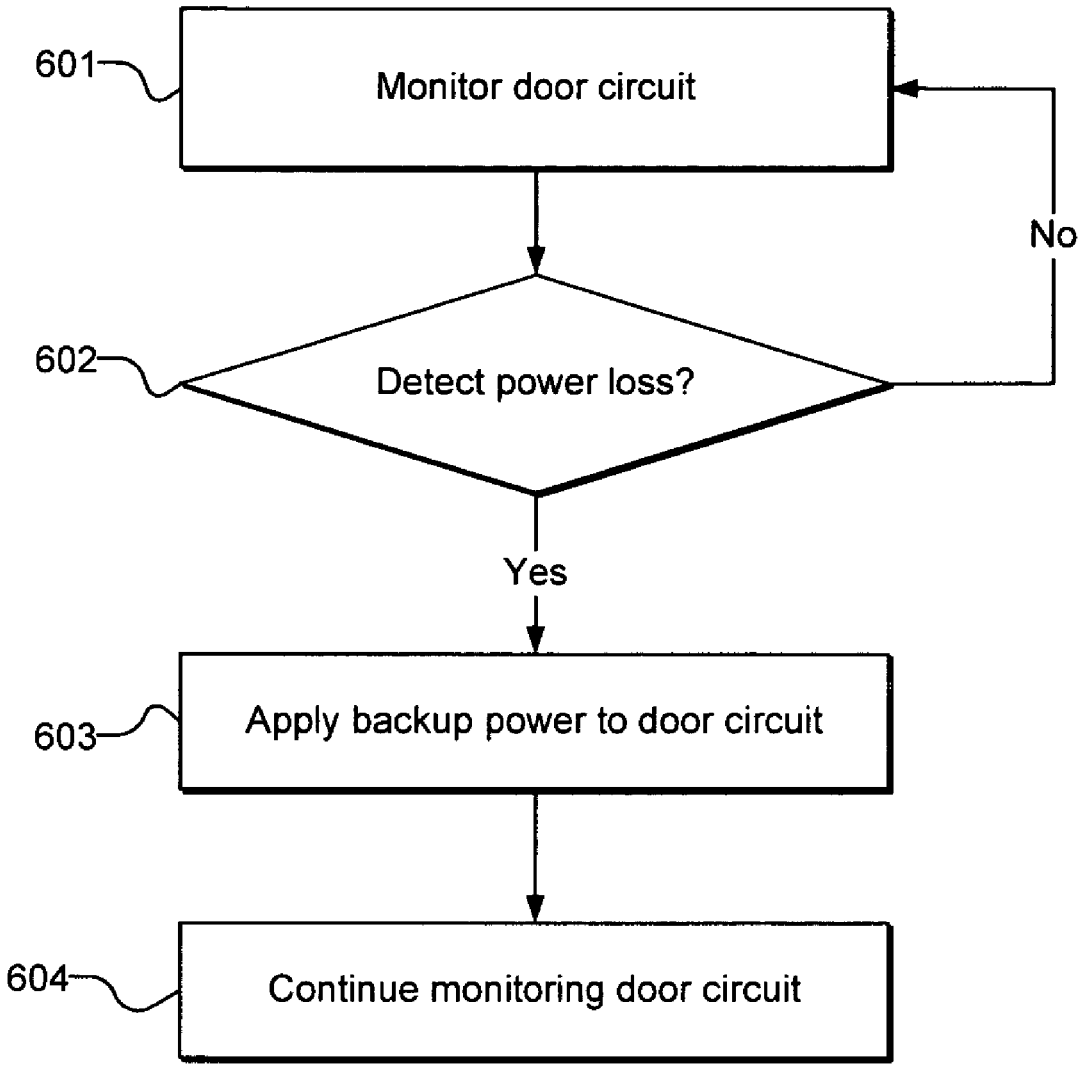
FIG. 6 shows a method of monitoring operation of a vending machine system, in accordance with embodiments of the present invention.

FIG. 6 shows a method of monitoring operation of a vending machine system, in accordance with embodiments of the present invention. In step 601, a door circuit for a vending machine access door is monitored to determine whether the access door is open or closed. In step 602, if a power loss in the door circuit is detected, then in step 603, backup power is applied to the door circuit. In step 604, the door circuit continues to be monitored using the backup power.

Figure 2:
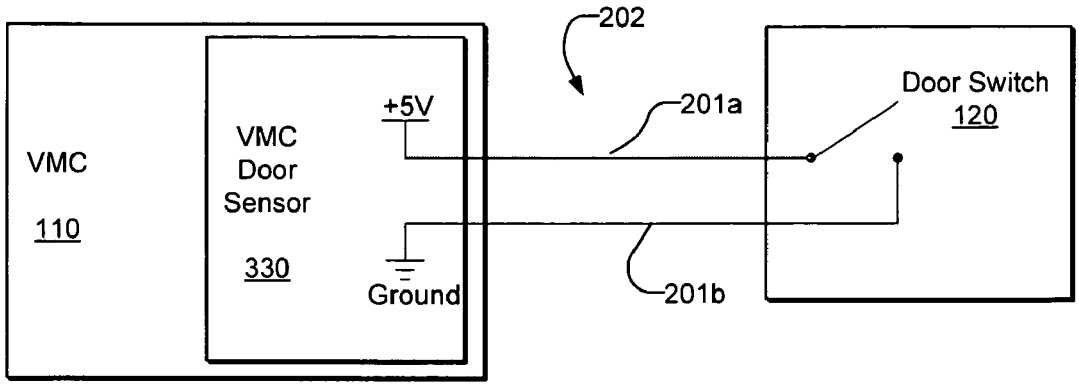
FIG. 2 is a simplified schematic illustrating the operation of a conventional door switch.

FIG. 2 is a simplified schematic illustrating the operation of a conventional door switch 120. Two lines 201*a*-201*b* connect the VMC 110 and the door switch 120 to form a door circuit 202. The VMC 110 includes a VMC door sensor 330, which receives power from a power supply 118. The VMC door sensor 330 applies a predetermined voltage to the first line 201*a*, typically 5 V (V+). The second line 201*b* remains at ground. In some vending machine systems, when the access door 122 is closed, the door switch 120 is also closed, thereby shorting the voltage line to ground. The VMC 110 detects this change and recognizes this as an indication that the access door 122 is closed.

In other vending machine systems, the door switch 120 may operate in different ways. For example, when the access door 122 is closed, the door switch 120 is open, thereby leaving the voltage line 201*a* high. In these types of systems, the VMC 110 will recognize that when the voltage line 201*a* is shorted to ground, the access door 122 is in an open state. Based on the open or closed door detection, the VMC 110 may be configured to respond in various ways, such as by placing the vending machine system 100 into service mode.

Figure 3:
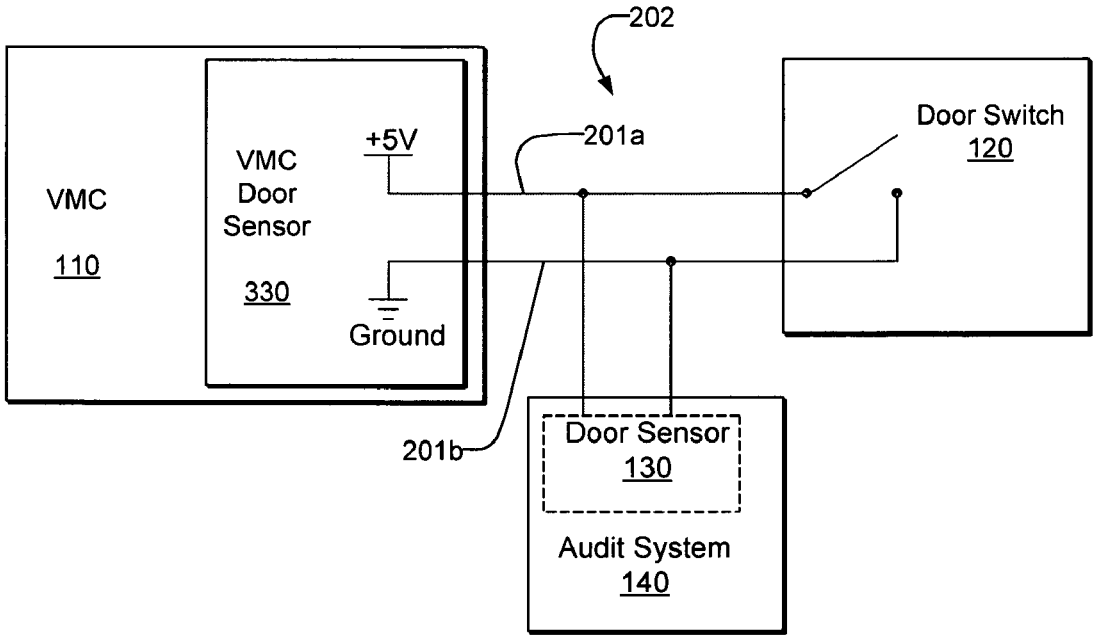
FIG. 3 shows the use of a door sensor with an existing door switch, in accordance with embodiments of the present invention.

FIG. 3 shows the use of an audit system door sensor 130 with an existing door switch 120, in accordance with embodiments of the present invention. Here, the audit system door sensor 130 is coupled to the door circuit 202 in parallel with the VMC door sensor 330. Thus, the audit system door sensor 130 can sense the changing voltage in the door circuit 202 in the same way as the VMC 110. In some embodiments, the door circuit 202 and door sensor 130 are optoisolated from the rest of the audit system 340. This can help to avoid damage to the logic in the audit system 340 in the event of a power surge in the door circuit 202.

The audit system door sensor 130 can be coupled to the door circuit 202 in a variety of ways. For example, lines 201*a*-201*b* can be spliced and joined to lines 204*a*-204*b* leading to the audit system door sensor 130. In other embodiments, the audit system door sensor 130 may be provided with a pair of input ports for coupling with the two lines emerging from the VMC 110 and a pair of output cables for coupling with a pair of input ports on the door switch 120.

The power supply 118 for the vending machine system 100 typically receives its power from an AC outlet in the facility where the vending machine system 100 is installed. A problem may arise when there is an interruption to the power supply to the VMC 110. The interruption to the power supply may occur for a variety of reasons, such as, e.g., a power failure in the facility, the power cord for the vending machine 100 being unplugged from the AC outlet, or a failure in the power supply 118. As a result of the loss of power, regardless of the status of the access door 122, both lines 201*a*-201*b* will effectively be drawn to ground because no voltage is being applied to the door circuit 202. Thus, neither the VMC 110 nor the audit system 140 will be able to determine the state of the access door 122.

Figure 4:
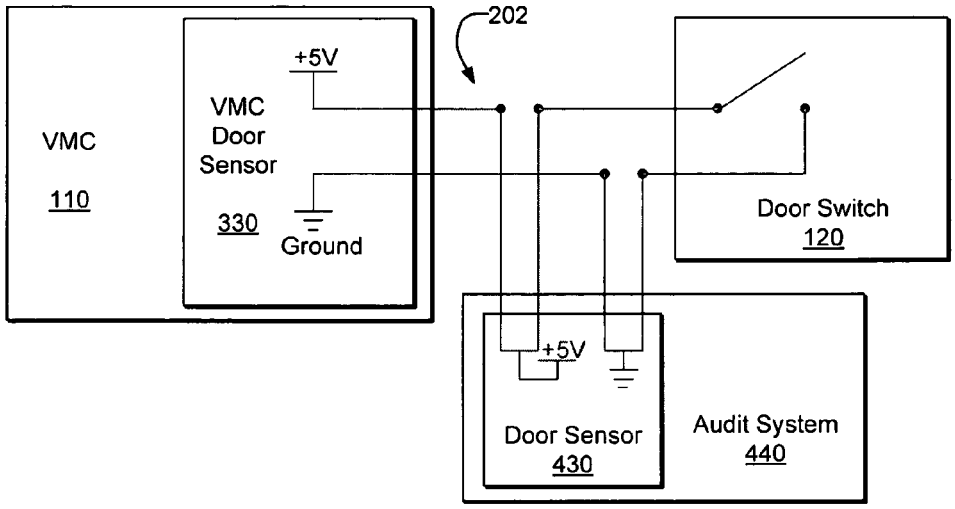
FIG. 4 shows a door sensor that can continue to monitor the status of an access door in the event of a power failure, in accordance with embodiments of the present invention.

FIG. 4 shows a retrofitable door sensor 430 that can continue to monitor the status of the access door 122 even when the VMC 110 ceases to power the door circuit 202. In this embodiment, when the VMC 110 is powering the door circuit 202, the door sensor 430 passes the applied voltage from the VMC 110 through to the door switch 120. If the audit system 140 detects that a voltage is no longer being applied by the VMC 110, the audit system 140 will supply power to the door circuit 202 using a battery backup. Thus, the audit system 140 will continue to be able to monitor the state of the access door 122, regardless of the state of the power supply 118.

As described above, conventional door circuits 202 have two lines, a voltage line and a ground line. However, different vending machine designs may configure the door switches in different ways. For example, the door switches in some vending machines may be configured such that when the door is opened, the circuit is open. In other vending machines, when the door is opened, the circuit is closed. Thus, when an audit system 140 having a door sensor 130 is installed in an unfamiliar vending machine system 100, the audit system 140 cannot assume what state of the door circuit 202 corresponds to an open access door 122.

In accordance with embodiments the present invention, the audit system 140 may be configured to perform an initialization process in which the audit system 140 detects the state of the door circuit 202 corresponding to each state of the access door 122. In one embodiment, an installer first installs the audit system 140 into the vending machine system 100, including coupling the door sensor 130 to the door circuit 202. Then, the installer powers on the audit system 140 while keeping the access door 122 open. Upon initial power on, the audit control system 150 performs an initial configuration and initialization process, which includes detection of the state of the door circuit 202. As a result of this initialization process, the audit control system 150 will associate the initial detected state of the door circuit 202 with the open state of the access door 122. This association can be stored in a nonvolatile memory of the audit system 140, so that the audit control system 150 will be able to continue to correctly recognize the state of the access door 122.

In other embodiments, the initialization process may be performed in different ways. For example, the audit system 140 may be provided with an initialization button. When this initialization button is depressed, the audit control system 150 will detect the state of the door circuit 202 and associate that with an open access door state. Other variations are possible.

Installation costs can add significantly to the overall cost of installing an audit system 140 into an existing vending machine system 100. In addition, mistakes made during the installation process can render the audit system 140 partially or completely inoperable, thus requiring an additional visit from service personnel in order to correct the mistakes. One potential source of installation error is the improper connection of the door sensor 132 to the door circuit 202. When attempting to tap into the wires connecting the VMC 110 in the door switch 120, is often difficult to discern which cable is the voltage line and which cable is the ground. In many cases, both cables are black and otherwise visibly indistinguishable. It may be possible to detect the voltage cable by using a voltmeter or other detection device, or by using trial and error to determine the proper connection of wires. However, these methods add to the installation time and require additional training of the installation personnel, thereby creating the potential for operator error.

Figure 5:
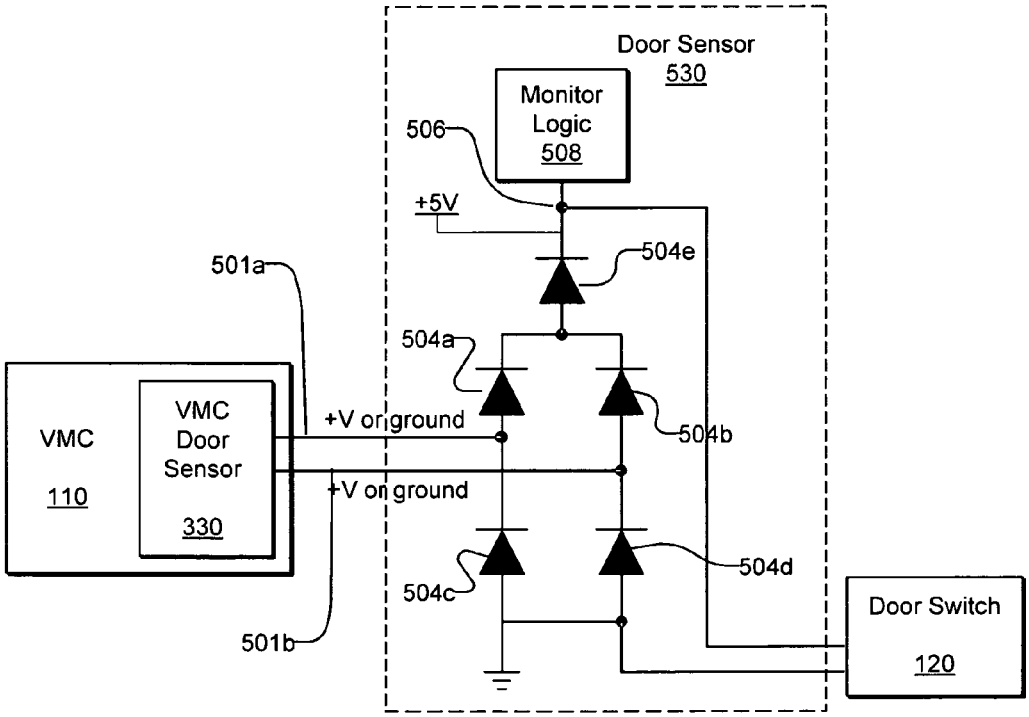
FIG. 5 shows a door sensor for automatically detecting the voltage line, in accordance with embodiments of the present invention.

In accordance with some embodiments, the audit system 140 may be configured to monitor the door circuit 202 regardless of the order in which the cables are coupled to the audit system 140. Thus, the installer does not need to determine which cable is the voltage line and which is the ground. FIG. 5 shows one embodiment of a door sensor 530 for automatically detecting the voltage line. As shown in FIG. 5, the VMC 110 has two lines 501*a*-501*b* to be connected to the door switch 120, but it is unclear which line is the voltage line and which line is the ground line. The door sensor 530 includes a sensor circuit comprising five Schottky diodes 504*a*-504*e*. The sensor circuit pulls the voltage up to terminal 506, where it is detected by monitor logic 508. Because the door switch 120 operates to simply open or close the circuit between lines 501*a* and 501*b*, the order in which the lines 501*a*-501*b* are coupled to the door switch 120 is irrelevant. The monitor logic 508 detects whether the voltage from the VMC 110 remains high or is drawn to ground by the closure of the door switch 120, as described above. Also, as described above with respect to FIG. 4, a backup battery may be provided for supplying a +5V voltage across the door switch 120 in the event of a power failure.

In accordance with some embodiments, the audit system 140 may be configured to implement a timer for reporting the door status. This timer can be used to avoid repeated "door open" messages in response to multiple repeated opening and closing of the access door over short periods of time. This may be caused, for example, if the service technician slams the access door closed, causing the access door to bounce slightly before settling into the fully closed position. This bounce may cause the door sensor to first detect a closure of the access door, immediately followed by an opening of the door and another closure. This may result in the audit system transmitting three separate messages to the host system. In another possible scenario, the service technician opens the access door briefly, but then closes it so that he or she can return to the supply truck to retrieve some essential item. The service technician will then return and open the vending machine door again within a few minutes. As with the previous example, multiple "door open" messages may be transmitted to the host system in this situation, even though this type of temporary door closure event need not be monitored.

In accordance with one embodiment, a timer begins each time the access door is open. When the door is first opened, the audit system will transmit a "door open" message to the host system. After a predetermined period of time (e.g., 30 minutes), the audit system will transmit a second message to the host system indicating the current state of the access door and the length of time that the door has been in that state. In one example, a technician opens the access door for 1 minute, then closes it, goes to the supply truck, returns to open the access door again 5 minutes later, and then completes the servicing of the vending machine in 10 minutes. In this case, the audit system will report the initial opening of the door and will transmit a follow-up message 30 minutes later. This follow-up message will indicate that the current state of the access door is closed and that the door has been in this state for 14 minutes. So long as the access door remains closed, no further door alert messages will be transmitted. If the access door remains open at the time of the follow-up message, the follow-up message will indicate this and the timer will be reset to transmit another follow-up message in 30 minutes.

Embodiments of the present invention may provide various advantages not provided by prior art systems. In particular, various embodiments may improve the accuracy with which an audit system can monitor the operation of a vending machine system. In addition, some embodiments may improve the ease with which audit units can be installed and reduce the chances of installation mistakes. This can, in turn, reduce labor costs for service personnel and improve the ability of the audit system to continuously monitor the vending machine.

In accordance with embodiments of the present invention, the presence of malfunctioning door switches can be more readily and effectively detected by transmitting door status information to the host system using the same door switch as the VMC. In addition, some embodiments can be implemented in order to track the performance of service personnel by monitoring the length of time the access door is open during any particular service visit. In other embodiments, the door status information may also be used to reconcile sales data by providing the host system with information regarding the date and time the vending machine was restocked. This information is provided without requiring that the service personnel manually press a "restock" button in the vending machine. In yet other embodiments, the door status information may be used to prevent theft and vandalism by enabling a host system to immediately detect when an access door is opened at unexpected times, e.g., late at night. In yet other embodiments, the door status information may be used to report when a machine is serviced by field technicians.

While the invention has been described in terms of particular embodiments and illustrative figures, those of ordinary skill in the art will recognize that the invention is not limited to the embodiments or figures described. For example, in many of the embodiments described above, the vending machine system dispenses physical products, such as drinks or snack foods, to customers in exchange for payment. In other embodiments, the products vended by the vending machine may take other forms, such as, e.g., a data download to a user's portable electronic device, or a service. It will be understood that the vending machine system may comprise any type of point-of-sale device and need not be limited to only those devices that deliver tangible products to customers.

In addition, the audit system may take various forms. In some embodiments, the audit system including the door sensor circuitry and logic are provided as a single installable component, like a "black box." In other embodiments, the audit system may comprise multiple components performing a variety of functions. The audit system may be retrofitted to an existing vending machine design, or may be an integral part of the system art initial assembly.

The program logic described indicates certain events occurring in a certain order. Those of ordinary skill in the art will recognize that the ordering of certain programming steps or program flow may be modified without affecting the overall operation performed by the preferred embodiment logic, and such modifications are in accordance with the various embodiments of the invention. Additionally, certain of the steps may be performed concurrently in a parallel process when possible, as well as performed sequentially as described above.

Therefore, it should be understood that the invention can be practiced with modification and alteration within the spirit and scope of the appended claims. The description is not intended to be exhaustive or to limit the invention to the precise form disclosed. It should be understood that the invention can be practiced with modification and alteration and that the invention be limited only by the claims and the equivalents thereof.

What is claimed is:

1. An audit system for a vending machine system comprising a housing including a door having a closed state and an open state, a door switch, and a vending machine controller (VMC) coupled to the door switch via a door circuit, said VMC applying a voltage across the door switch, said audit system comprising:

an auxiliary circuit coupled to the door circuit; and an audit control system configured to detect the status of the door switch by monitoring the voltage from the VMC, wherein the audit control system is configured such that if the audit control system detects cessation of the voltage from the VMC, the audit control system applies an auxiliary voltage across the door switch to detect the status of the door switch.

2. The system of claim 1, further comprising:

a battery for supplying the auxiliary voltage across the door switch.

3. The system of claim 1, wherein:

said audit control system is configured to perform an initialization process in which the audit control system determines a state of the door circuit corresponding to the open state of the door.

4. The system of claim 3, wherein:

said audit control system performs the initialization process at startup.

5. The system of claim 1, wherein:

the VMC comprises a voltage terminal and a ground terminal; and the audit system comprises a first input terminal and a second input terminal coupled to the voltage terminal and the ground terminal, said audit control system being configured to monitor the voltage passing through the door switch regardless of whether the first input terminal is coupled to the voltage terminal or the ground terminal.

6. The system of claim 5, wherein:

the audit system comprises a sensor circuit coupled to the voltage terminal and the ground terminal, said sensor circuit configured to pull a positive voltage to a monitoring logic to monitor the voltage passing through the door switch.

7. The system of claim 1, wherein:

said audit system further comprises a communications interface and is configured to transmit an open door status message to a host system via the communications interface upon detection of the open state of the door.

8. The system of claim 7, wherein:

said audit system is further configured to transmit a door status update message to the host system via the communications interface after a predetermined period of time following the transmission of the open door status message.

9. The system of claim 8, wherein:

said door status update message comprises an indication of a current state of the door and the length of time the door has been in the current state.

10. A method of monitoring operation of a vending machine system, said method comprising:

monitoring a door circuit between a first power source and a door switch, said door switch engaging an access door for the vending machine system;

in response to a cessation of a voltage from the first power source, applying a voltage from a second power source and continuing to monitor the door circuit between the first power source and the door switch to detect at least a current status of the door switch.

11. The method of claim 10, further comprising:

performing an initialization process in which a state of the door circuit corresponding to the open state of the door is determined.

12. The method of claim 11, wherein:

said initialization process is performed at startup of an audit system.

13. The method of claim 10, wherein:

said monitoring the door circuit comprises connecting an audit system to the door circuit, said audit system automatically detecting a voltage line from the first power source.

14. The method of claim 13, wherein:

the audit system comprises a sensor circuit coupled to a voltage terminal and a ground terminal, said sensor circuit configured to pull a positive voltage to a monitoring logic to monitor the voltage passing through the door switch.

15. The method of claim 10, further comprising:

upon detection of an open state of the access door, transmitting an open door status message to a host system via a communications interface.

16. The method of claim 15, further comprising:

transmitting a door status update message to the host system via the communications interface after a predetermined period of time following the transmission of the open door status message.

17. The method of claim 16, wherein:

said door status update message comprises an indication of a current state of the door and the length of time the door has been in the current state.

18. A method of operating a vending machine system, comprising:

monitoring a door circuit coupling a door switch and a vending machine controller (VMC) using an audit system;

detecting a cessation of voltage in the door circuit; and responsive to the cessation of voltage applying an auxiliary voltage to the door circuit to continue to monitor the door circuit and detect at least a current status of the door switch.

19. The method of claim 18, wherein:

performing an initialization process in which a state of the door circuit corresponding to the open state of the door is determined.

20. The method of claim 19, wherein:

said initialization process is performed at startup of an audit system.

21. The method of claim 18, wherein:

said monitoring the door circuit comprises connecting an audit system to the door circuit, said audit system automatically detecting a voltage line from the first power source.

22. The method of claim 21, wherein:

the audit system comprises a sensor circuit coupled to a voltage terminal and a ground terminal, said sensor circuit configured to pull a positive voltage to a monitoring logic to monitor the voltage passing through the door switch.

23. The method of claim 18, further comprising:

upon detection of an open state of the access door, transmitting an open door status message to a host system via a communications interface.

24. The method of claim 23, further comprising:

transmitting a door status update message to the host system via the communications interface after a predetermined period of time following the transmission of the open door status message.

25. The method of claim 24, wherein:

said door status update message comprises an indication of a current state of the door and the length of time the door has been in the current state.

26. A vending machine system, comprising:

a housing including a door having a closed state and an open state;

a door switch;

a first means for applying a voltage across the door switch and for detecting a state of the door switch; and a second means for detecting the state of the door switch, wherein said second means applies an auxiliary voltage across the door switch in response to detection of a cessation of the voltage applied by the first means.

27. The system of claim 26, further comprising:

a battery for supplying the auxiliary voltage across the door switch.

28. The system of claim 26, wherein:

said second means is configured to perform an initialization process in which the second means determines a state of the door switch corresponding to the open state of the door.

29. The system of claim 28, wherein: said second means performs the initialization process at startup.

30. The system of claim 26, wherein:

said first means comprises a voltage terminal and a ground terminal; and said second means comprises a first input terminal and a second input terminal coupled to the voltage terminal and the ground terminal, said second means being configured to monitor the voltage passing through the door switch regardless of whether the first input terminal is coupled to the voltage terminal or the ground terminal.

31. The system of claim 30, wherein:

said second means comprises a sensor circuit coupled to the voltage terminal and the ground terminal, said sensor circuit configured to pull a positive voltage to a monitoring logic to monitor the voltage passing through the door switch.

32. The system of claim 26, further comprising:

a means for generating an open door status message to be transmitted to a host system via a communications interface upon detection of the open state of the door.

33. The system of claim 32, wherein:

said means for generating the open door status message is further configured to transmit a door status update message to the host system via the communications interface after a predetermined period of time following the transmission of the open door status message.

34. The system of claim 33, wherein:

said door status update message comprises an indication of a current state of the door and the length of time the door has been in the current state.

* * * * *